US006966762B1

(12) United States Patent
Maggio et al.

(10) Patent No.: US 6,966,762 B1
(45) Date of Patent: Nov. 22, 2005

(54) DEVICE FOR OPENING AND DISTRIBUTING A BUNDLE OF FILAMENTS WHEN PRODUCING A NONWOVEN TEXTILE WEB

(75) Inventors: Rosario Maggio, Varese (IT); Laurent Schmit, Saint Martin d'Heres (FR)

(73) Assignee: Rieter Perfojet, Montbonnot (FR)

( * ) Notice: Subject to any disclaimer, the term of this patent is extended or adjusted under 35 U.S.C. 154(b) by 0 days.

(21) Appl. No.: 10/030,880

(22) PCT Filed: Apr. 20, 2000

(86) PCT No.: PCT/FR00/01050

§ 371 (c)(1),
(2), (4) Date: Feb. 22, 2002

(87) PCT Pub. No.: WO00/65134

PCT Pub. Date: Nov. 2, 2000

(30) Foreign Application Priority Data

Apr. 23, 1999 (FR) ..... 99 05403

(51) Int. Cl.[7] ..... D01D 5/92
(52) U.S. Cl. ..... 425/66; 425/72.2; 425/174.8 E; 19/299
(58) Field of Search ..... 425/66, 72.2, 174.8 R, 425/174.8 E, DIG. 17; 19/299

(56) References Cited

U.S. PATENT DOCUMENTS

| | | | | |
|---|---|---|---|---|
| 3,286,896 A | | 11/1966 | Kinney | 226/97 |
| 3,325,906 A | | 6/1967 | Franke | 34/10 |
| 3,334,161 A | | 8/1967 | De Guzman | 226/7 |
| 3,338,992 A | | 8/1967 | Kinney | 264/441 |
| 3,341,394 A | | 9/1967 | Kinney | 442/366 |
| 3,402,227 A | | 9/1968 | Knee | 264/438 |
| 3,967,118 A | | 6/1976 | Sternberg | 250/325 |
| 4,820,142 A | * | 4/1989 | Balk | 348/97 |
| 5,225,018 A | | 7/1993 | Zeldin et al. | 156/167 |
| 5,397,413 A | | 3/1995 | Trimble et al. | 156/167 |
| 5,460,500 A | * | 10/1995 | Geus et al. | 425/66 |
| 5,702,730 A | | 12/1997 | Reifenhauser et al. | 425/72.2 |
| 5,766,646 A | | 6/1998 | Geus et al. | 425/72.2 |
| 5,800,840 A | * | 9/1998 | Geus et al. | 425/7 |

(Continued)

FOREIGN PATENT DOCUMENTS

DE 24 21 401 A1 11/1975

(Continued)

OTHER PUBLICATIONS

Brockhaus Enzyklopadie, F. A. Brockhaus Mannheim, p. 57.

*Primary Examiner*—Joseph S. Del Sole
(74) *Attorney, Agent, or Firm*—Pearne & Gordon LLP

(57) ABSTRACT

The invention concerns a device for opening and distributing a bundle of filaments when producing a nonwoven textile web by a technique which consists in: extruding melted organic polymer through a die perforated with holes, so as to form a bundle or curtain of filaments; then directing the extruded filaments by drawing by means of one or several fluid jets; and finally, receiving the bundle of filaments in the form of a web on a mobile conveyor belt. The invention is characterised in that it consists of an assembly arranged downstream of the outlet of the drawing assembly and separate therefrom, said assembly comprising, arranged in the proximity of the drawing slot outlet, a diffuser comprising an intake zone shaped as a convergent nozzle extending over the whole width of the installation opposite the drawing slot outlet producing the web, extended by a divergent nozzle, said assembly being associated with a ramp electrostatically charging the filaments before they are received on the receiving belt.

14 Claims, 3 Drawing Sheets

U.S. PATENT DOCUMENTS

| | | | | |
|---|---|---|---|---|
| 5,814,349 | A | 9/1998 | Geus et al. | 425/66 |
| 6,117,801 | A | 9/2000 | McGinty et al. | 442/352 |

FOREIGN PATENT DOCUMENTS

| | | | |
|---|---|---|---|
| DE | 28 38 977 | A1 | 3/1980 |
| DE | 37 27 374 | A1 | 4/1988 |
| DE | 40 14 989 | A1 | 11/1991 |
| DE | 43 12 419 | A1 | 10/1994 |
| DE | 195 18 895 | A1 | 11/1995 |
| DE | 195 21 466 | A1 | 12/1996 |
| DE | 196 20 379 | A1 | 11/1997 |
| EP | 0 635 077 | B1 | 1/1995 |
| EP | 0 453 564 | B1 | 7/1995 |
| FR | 2 309 654 | | 11/1976 |
| JP | 60-094663 | | 5/1985 |
| JP | 63-282351 | | 11/1988 |
| JP | 5-9535 | | 2/1993 |
| JP | 53-11562 | | 11/1993 |
| WO | WO 98/44176 | | 10/1998 |

* cited by examiner

DEVICE FOR OPENING AND DISTRIBUTING A BUNDLE OF FILAMENTS WHEN PRODUCING A NONWOVEN TEXTILE WEB

TECHNICAL FIELD

The invention relates to an improvement made to the installations for making a nonwoven textile web, which is commonly referred to by the generic name of spunbond and which is formed by continuous synthetic filaments.

It concerns more particularly, an improvement made to the means for distributing the extruded filaments, after drawing, over a movable transporting belt, over which they are randomly distributed so as to form a regular web, with a weight and thickness which can be adjusted according to the applications.

PRIOR ART

The production of nonwoven webs of the spunbond type goes back decades and consist, generally speaking:

- in extruding a melted organic polymer through a spinneret perforated with holes, so as to form a bundle or curtain of filaments;
- then, in orienting the extruded filaments by drawing by means of one or more fluid jets, in particular, compressed air devices; and, finally
- in receiving the bundle of filaments in the form of a web on a movable transporting belt, which is generally subjected to a suction source and the speed of which is adjusted according to the characteristics of the web, in particular thickness, which it is desired to achieve.

After production, the web is consolidated, for example, by performing a sizing or calendering, preferably hot calendering, so that the elementary filaments are joined to one another.

Other consolidation treatments may be performed, where appropriate, such as, for example, a needling treatment (conventional or by fluid jets), and/or the deposition of a bonding substance on the surface or in the interior of the web.

Generally speaking, the installations used to produce such products comprise:

- at lease one extruder for a melted organic polymer feeding a spinneret for producing a curtain of filaments;
- a cooling zone for bringing about at least surface solidification of the said extruded filaments;
- a suction device in the form of a narrow chamber of rectangular cross-section, inside which the curtain of filaments is subjected to the action of high-speed air streams causing the filaments to be drawn, which assembly will be referred to hereinbelow by the term "drawing slot"; and
- a means for deflecting and slowing down the air flow at the outlet of the drawing slot and for distributing the filaments randomly over a receiving belt.

In such installations, the filaments emerge at the outlet of the drawing slot in the form of a bundle of filaments grouped together in the mid-plane of the slot.

These filaments are ejected at very high speed from the drawing slot, a speed which can reach 3000 m/min or more depending on the state.

In order to obtain a nonwoven web as homogeneous as possible on the receiving belt onto which the filaments leaving the drawing slot are projected, it is necessary not only to separate the filaments from one another, but also to slow down their speed before their impact with the belt, in order to limit the uncontrollable rebound phenomena which generate a heterogeneous formation of the sheet.

To ensure such a break-up and distribution of the curtain of extruded filaments, various techniques have been proposed to date.

The oldest technique, which emerges in particular from the patent GB-A 932,482, and from the patent U.S. Pat. No. 3,967,118, consists in electrostatically charging the filaments, which tends to push them away from one another (corona effect).

This technology makes it possible to improve the formation of the sheet when the filaments are ejected at relatively low speed from the drawing slot. Consequently, the so-called grouping-together phenomena of the filaments are dominant over those of the rebounding of the filaments on the belt.

This is the case, in particular, when the sheet consists of relatively coarse filaments, that is to say, with a count greater than or equal to 2.2 dtex per filament. Such filaments are generally produced with speeds at the drawing-slot outlet of less than 3000 m/min.

In order to reduce the speed without adding an additional element, it is necessary in this case for the end of the drawing slot on which the electrostatic device is fixed to be situated at a relatively large distance from the receiving belt, of the order of 500 mm or more. This enables the frictional forces of the filaments in the air to slow down their speed, thereby limiting the rebound phenomena and thus improving the formation of the sheet.

This device is not entirely satisfactory, since no control of the speed is possible and the filaments are also subjected to all the outside air currents, thereby disrupting the sheet and creating defects.

Finally, the simple friction of the filaments in the air over such a short distance does not permit sufficient slowing-down of their speed to enable the rebound phenomena of the filaments on the belt to be attenuated sufficiently.

Consequently, it has been proposed, as emerges from the patent U.S. Pat. No. 3,286,896, to fit to the end of the drawing slot (see FIGS. 7 and 8) a deflecting system to ensure a better distribution and opening of the bundles of filaments produced.

However, since this solution does not give complete satisfaction, it has been proposed, as emerges from the patent U.S. Pat. No. 3,325,906, to associate with the divergent nozzle at the drawing-slot outlet, an assembly for insufflating air on each side of this divergent nozzle. This creates a negative pressure in the vicinity of the walls, thus attracting the fibers towards the walls, thereby tending to open the bundle of filaments and also slow down the speed thereof.

Such a device, which is satisfactory in theory, nevertheless has a limited effectiveness. This is true since it is mainly the fibers situated on each side of the bundle which are thus "spread", those grouped together at the center of the said bundle being extremely difficult to separate from one another.

SUMMARY OF THE INVENTION

Now, it has been found, and this forms the subject of the invention, that it was possible to achieve not only a perfect opening of the bundle of extruded filaments at the outlet of the drawing slot, but also a very homogeneous distribution over the receiving belt. This is achieved, on the one hand, by separating the assembly for opening the bundle of filaments from the actual drawing slot, and on the other hand, and above all, by designing this opening assembly such that it combines both the advantages of the techniques of electrostatically charging the filaments and the techniques of opening the bundle by slowing down the air speed at the drawing-slot outlet, and thus the speed of the filaments before reception on the receiving belt.

Generally speaking, the invention thus relates to a device for opening and distributing a bundle of filaments during the production of a nonwoven textile web. This is achieved according to the technique which consists:

- in extruding a melted organic polymer through a spinneret perforated with holes, so as to form a bundle or curtain of filaments;
- then, in orienting the extruded filaments by drawings by means of one or more fluid jet devices; and, finally
- in receiving the bundle of filaments in the form of a web on a movable transporting belt below which is arranged a suction source.

The device for opening and distributing the bundle of filaments according to the invention consists of an assembly arranged downstream of the outlet of the drawing assembly and separated therefrom. This assembly is arranged close to the outlet of the drawing slot, a diffuser comprising an inlet zone in the form of a convergent nozzle extending over the entire width of the installation opposite the outlet of the drawing slot for producing the web, extended by a divergent nozzle. The assembly is associated with a rail that electrostatically charges the filaments before they are received on the receiving belt.

According to one embodiment, the divergent zone of the diffuser comprises two walls and two lateral slots situated at the top of the diffuser on each side thereof. This permits either an indraught of air from outside due to the venturi effect, or, where appropriate, an injection of air under a pressure less than one bar and advantageously between 0.4 and 0.8 bar, bringing about an air flow against the walls of the diffuser.

The above diffuser makes it possible to precisely adjust the width of the bundle of fibers and also the impact speed of the filaments on the receiving belt. The electrostatic charging assembly being able to be situated, where appropriate, downstream of the diffuser assembly, but preferably being integrated inside the latter, thereby accentuating the opening of the bundle of filaments.

Advantageously and in practice:

- the diffuser comprises an inlet zone in the form of a convergent nozzle connected to the two walls of the divergent zone by a rectilinear slot, the rail electrostatically charging the filaments being mounted at the level of the rectilinear slot immediately upstream of the divergent zone;
- the distance of the diffuser from the receiving belt is adjustable, in order to minimize the influence of the outside air currents on the bundle of fibers;
- the pressure of the air which flows in the diffuser against the walls thereof and the adjustment of the voltage applied in the electrostatic rail makes it possible to adapt very precisely the conditions of the formation of the sheet according to the speed of the filaments at the drawing-slot outlet, thereby making particularly such a device suitable for the formation of a sheet consisting of low-denier filaments, and also for production installations working at high speed; and, finally
- the separation of the actual drawing system and that for distributing the curtain of filaments allows a possibility of adjusting the count of the filaments without changing the appearance of the sheet and vice versa.

BRIEF DESCRIPTION OF THE DRAWINGS

The invention and the advantages which result from it will be better understood through the exemplary embodiment which is given by way of guidance but without limitation, and which is illustrated by the attached diagrams, in which.

DETAILED DESCRIPTION OF THE DRAWINGS

Referring to the attached figures, the device according to the invention is intended for use on a line for producing a nonwoven textile web consisting of continuous synthetic filaments.

Figure 1:
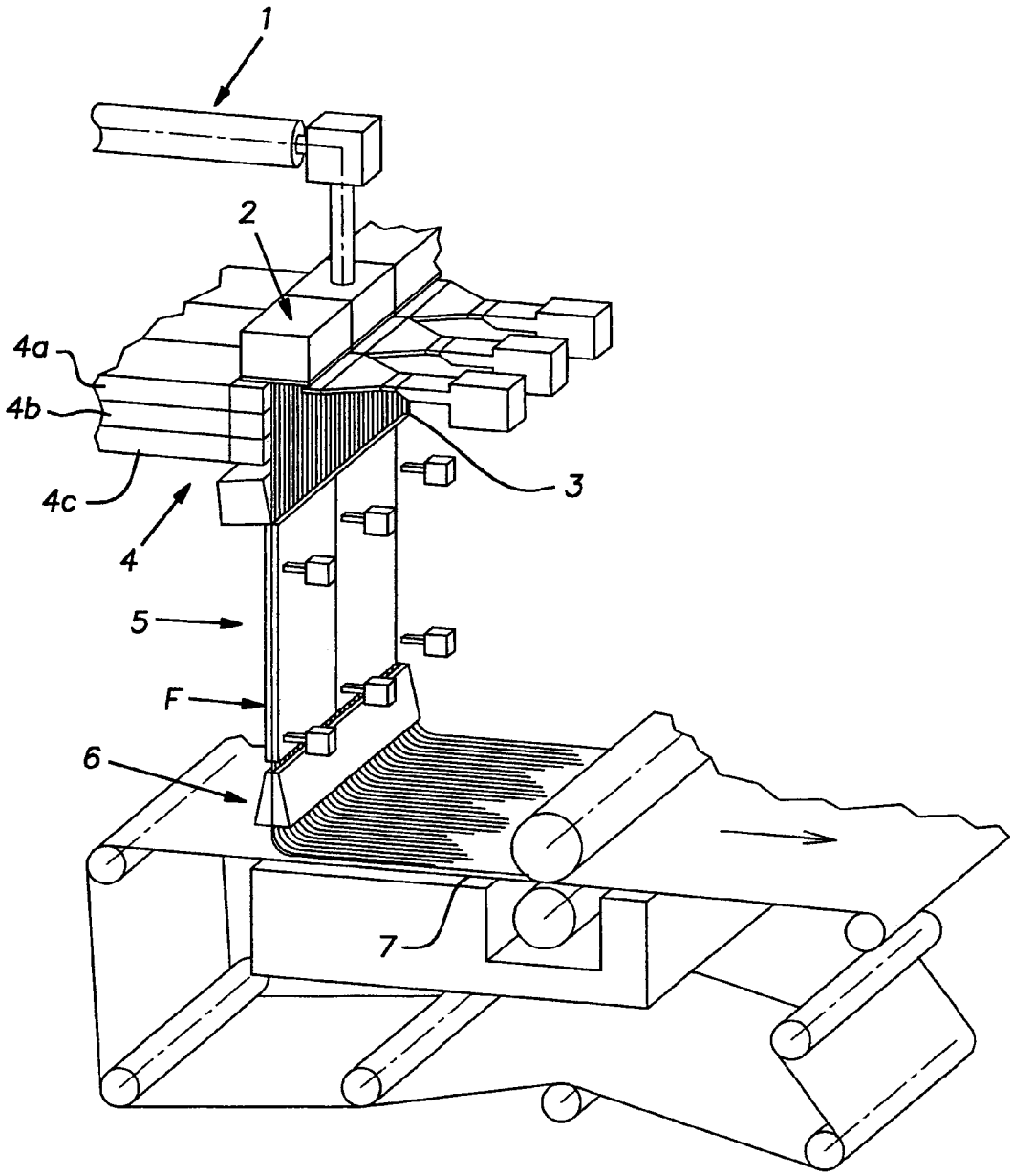
FIG. 1 is a general view of an installation for producing a nonwoven web of the spunbond type.

Generally speaking, as can be seen from FIG. 1, such an installation is composed essentially of at least one extruder, designated by the general reference 1, which feeds synthetic polymer, such as polyamide, polyethylene, polyester, etc., to a spinneret 2 for the formation of a curtain of filaments 3.

From a practical point of view, by way of guidance, the spinneret consists of a plate each containing a multitude of holes, for example 5000 per meter of width and having a diameter depending on the extruded filaments, for example, 0.5 mm. These holes are distributed over a plurality of parallel rows, for example over eighteen rows, and over a width at the spinneret outlet of 140 mm.

At the outlet of this spinneret is arranged the cooling assembly 4 for adjusting the temperature of the filaments depending on the polymers. For example, the cooling assembly may comprise a plurality of successive zones 4*a*, 4*b* and 4*c*, for subjecting the curtain of filaments 3 to traversing air flows. The speed and temperature of the traversing air flows may be adjusted.

By way of illustration, the length of the cooling zone is of the order of 1200 mm. The temperature and speed if filaments in each of the zones decreases from the first zone 4*a* to the third zone 4*c*.

Downstream of the cooling zone 4*c* is arranged the actual drawing assembly 5. The drawing assembly 5 is in the form of a closed enclosure having a slot "F" into which air is injected under pressure, for example, of the order of 0.5 bar.

Such a drawing system makes it possible to bring about the suction of the curtain of filaments and its entrainment by high-speed air streams for effecting the drawing.

At the outlet of the drawing assembly 5, the bundle of filaments 3 is projected onto the receiving belt 7 by way of an opening and distributing assembly 6. The assembly 6 forms the subject of the invention, the two embodiments of which can be seen in FIGS. 2 and 3. The assembly 6 causes the air flow leaving the slot "F" to deviate and slow down, thus bringing about the opening of the bundle of filaments.

Figure 2:
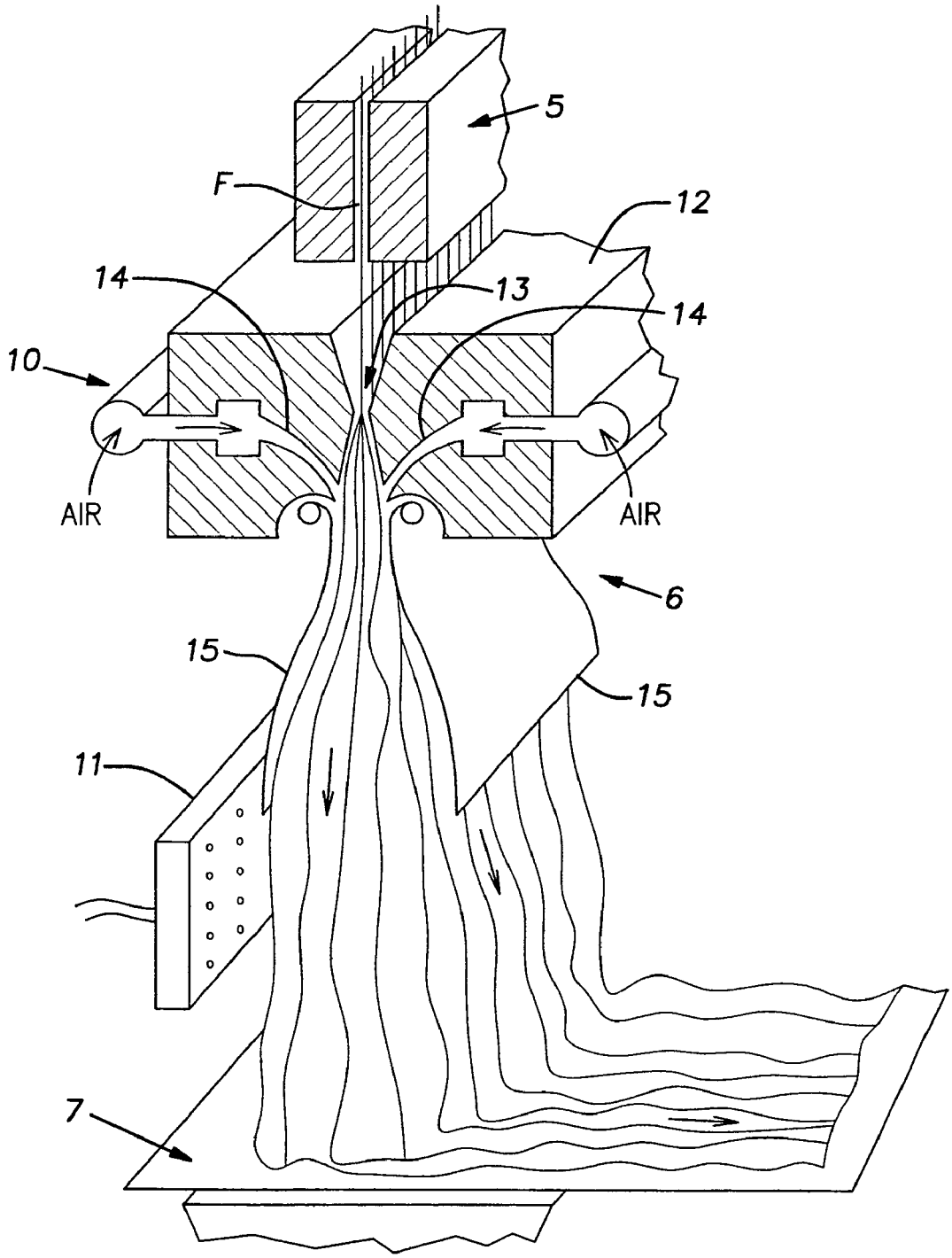
FIG. 2 is a detail view showing schematically the structure and functioning of an assembly for the opening of the bundle of filaments which is formed and its deposition on the receiving belt.

In the first embodiment illustrated in FIG. 2, the assembly 6 comprises, close to the outlet of the drawing slot "F" of the assembly 5, on the one hand, a diffuser designated by the general reference 10, and a downstream rail 11. The diffuser 10 consists essentially of a divergent nozzle which extends over the entire width of the web being produced. On the other hand, downstream of this opening assembly, a rail 11 arranged to electrostatically charge the filaments at the outlet of the assembly 10, and thereby ring about an opening at the heart of the bundle of filaments before they are deposited on the receiving belt 7.

In this embodiment, the diffuser assembly 10 is composed essentially of a chamber 12 having an inner slot 13. The slot 13 is in the form of a convergent/divergent nozzle extending over the entire width of the installation opposite the outlet of the drawing slot "F" of the assembly 5.

Opening into this slot 13, close to the lower part of the divergent zone, are two laterally arranged symmetrical slots 14. These symmetrical slots 14 may be either connected to a source of compressed air injected under a pressure less than 1 bar and advantageously of the order of 0.4 bar, or be simply open to the outside air.

The divergent zone is, in this embodiment, extended by two walls 15 which are likewise divergent.

Arranged immediately downstream of this diffuser assembly, or where appropriate integrated inside the latter, is a conventional rail 11 for electrostatically charging the filaments. This makes it possible to intensify the opening of the bundle. The rail 11 is a conventional rail, for example of the type described in U.S. Pat. No. 3,967,118.

Figure 3:
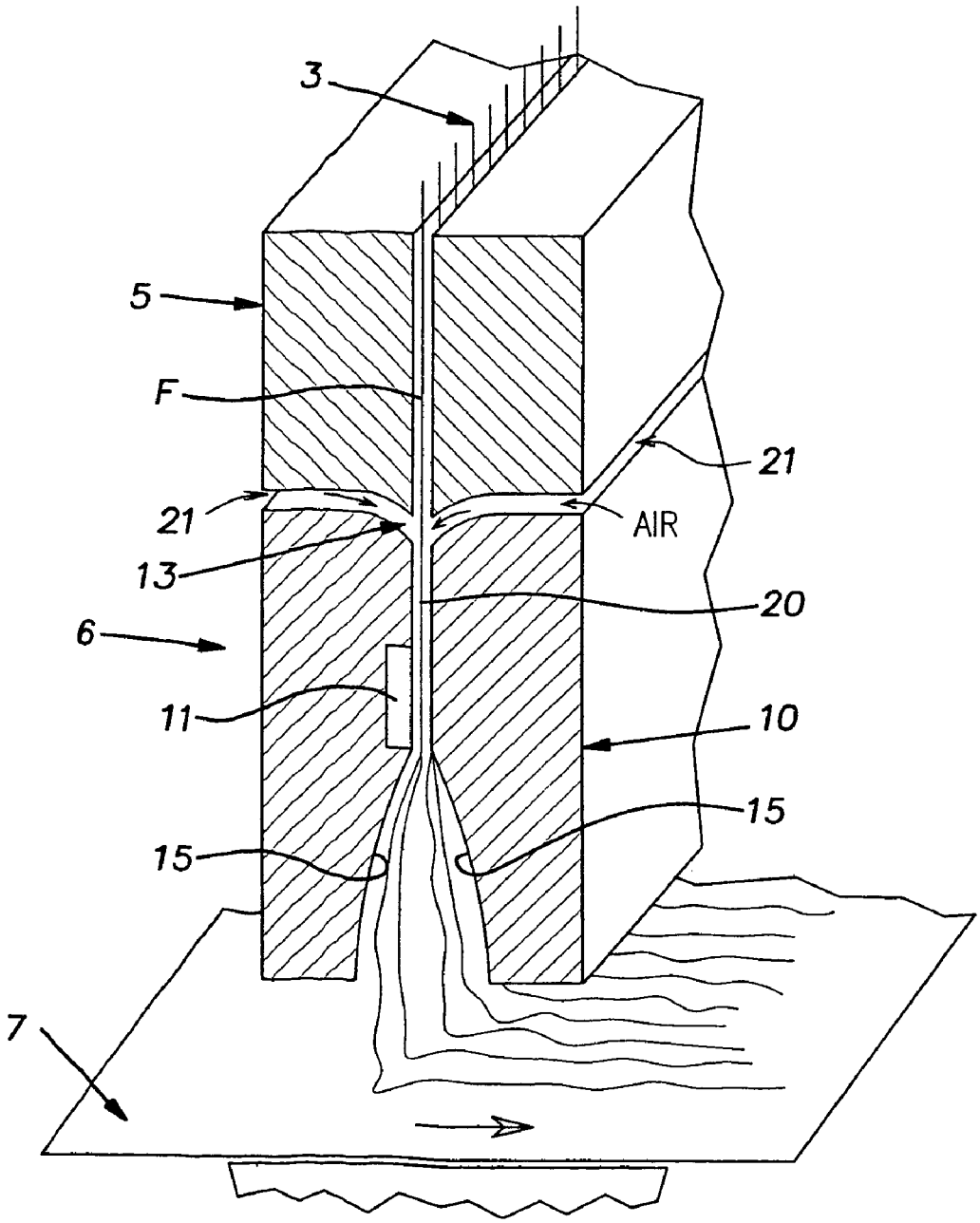
FIG. 3 illustrates a modified embodiment according to the invention in which the electrostatic charging of the filaments is obtained by way of a rail integrated inside the diffuser, and wherein it is possible for the flow of air inside the latter against the walls to be produced either by natural indraught of the outside air, or by a system of injection under low pressure less than one bar.

FIG. 3 illustrates a second embodiment of the assembly 6 for opening and distributing a bundle of filaments in the form of a web produced in accordance with the invention.

In this variant, using the same references as those employed to describe the example illustrated by FIG. 2, the assembly 6 for opening and distributing the bundle of filaments 3 is, as before, separated from the drawing assembly 5.

This embodiment also comprises an inlet zone 13 in the form of a convergent nozzle extending opposite the outlet of the drawing slot "F". This inlet zone 13 in the form of a convergent nozzle is connected to the two walls 15 of the divergent zone by a rectilinear slot 20.

The rail 11 for electrostatically charging the filaments is, in this embodiment, integrated inside the diffuser 10 at the end of the rectilinear slot 20 immediately upstream of the divergent zone 15.

An indraught of air coming from outside owing to the venturi effect is produced through the two adjacent lateral slots formed by the lower face of the drawing assembly 5 and the upper face of the opening and distributing assembly 6.

An air flow thus arises along the walls 20, 15 over the opening and distributing assembly.

Where appropriate, as in the embodiment described in conjunction with FIG. 2, an injection of air under low pressure, less than 1 bar, could be produced at the two lateral slots formed between the drawing assembly 5 and the opening and distributing assembly 6.

It was found that with such a device not only was a perfect opening of the bundle of filaments obtained, but that, furthermore, the reception of the belt 7 was very regular and led to a very homogeneous nonwoven web being obtained.

Of course, the invention is not limited to such an embodiment, but covers any variants thereof realized in the same spirit.

What is claimed is:

1. A machine for making a nonwoven web comprising successively from top to bottom:

a cooling assembly for cooling extruded filaments to form cooled filaments, a drawing assembly with fluid jet devices providing air flow for drawing the cooled filaments, said drawing assembly including a vertical drawing slot having an inlet opening, an outlet opening and a constant horizontal cross-section through which filaments pass with air to form a laterally extending curtain of drawn filaments, said drawing slot being formed by laterally extending spaced-apart walls terminating at the outlet opening, said drawing slot having a lateral extent to receive said curtain of drawn filaments, a diffuser having an inlet zone including a diffuser inlet opening having a lateral extent to receive said curtain of drawn filaments and being connected to a diffuser outlet zone including a diffuser outlet opening, said diffuser including a divergent nozzle and an electrostatically charging rail for opening drawn filaments which pass therethrough to form opened filaments, said divergent nozzle being formed by fixed diverging walls terminating at said diffuser outlet opening, and a receiving belt for receiving said opened filaments, said diffuser outlet opening being spaced from said belt to form a receiving belt spacing, wherein an air flow slot is formed between the drawing assembly outlet opening and the diffuser inlet opening for delivery of a flow of air onto said filaments along the entire lateral extents of the openings, said air flow slot opening to ambient air for intake of air by a venturi effect produced in the divergent nozzle by air passing therethrough with said drawn filaments, and said receiving belt spacing being open to the ambient air.

2. The machine of claim 1, wherein said air flow slot delivers said flow of air at said drawing slot outlet opening to reduce the air speed and the speed of the passing filaments.

3. The machine of claim 2, wherein a second air flow slot remote of said first-mentioned air flow slot extends through said diffuser and opens into said divergent nozzle for injection therein of air by venturi effect produced in the divergent nozzle by air passing therethrough with said drawn filaments.

4. The machine of claim 3, wherein said air flow slots take in air by venturi effect only.

5. The machine of claim 4, wherein said rail is located between said divergent nozzle and said receiving belt.

6. The machine of claim 1, wherein said rail is located upstream from said divergent nozzle.

7. The machine of claim 6, wherein said convergent and divergent nozzles are connected by a rectilinear slot.

8. The machine of claim 7, wherein said rail is located in said rectilinear slot.

9. A machine for making a nonwoven web comprising:

a drawing assembly for drawing filaments which pass therethrough with air to form drawn filaments, a diffuser having an inlet zone formed by a convergent nozzle and a divergent nozzle connected to said convergent nozzle for opening drawn filaments which pass therethrough into opened filaments, a rail for electrostatically charging said opened filaments to form charged filaments, and a receiving belt for receiving said charged filaments, wherein a slot is formed in the divergent nozzle for delivery of a flow of air onto said filaments, said slot opening to ambient air for intake of air by a venturi effect produced in the divergent nozzle by air passing therethrough with said drawn filaments, and said convergent and divergent nozzles slow the passing filaments to enhance spreading of the filaments by said electrostatically charging and thereby cooperatively obtain an improved spreading of the filaments and a reduced rebound phenomena of filaments on said receiving belt.

10. The machine of claim 9, wherein a second slot remote of said first-mentioned slot is formed between said drawing assembly and said diffuser for delivery of a flow of air into said filaments, said slots opening to the ambient air for intake of air by a venturi effect produced in the divergent nozzle by air passing therethrough with said drawn filaments.

11. The machine of claim 10, wherein said drawing assembly includes a drawing slot outlet from which the drawn filaments are emitted, said drawn filaments being received in said diffuser inlet zone, and said second slot delivers said flow of air at said drawing slot outlet to reduce the air speed and the speed of the passing filaments.

12. The machine of claim 11, wherein said slots take in air by venturi effect only.

13. The machine of claim 10, wherein said rail is located between said divergent nozzle and said receiving belt.

14. A machine for making a nonwoven web comprising successively from top to bottom:

a cooling assembly for cooling extruded filaments to form cooled filaments, a drawing assembly with fluid jet devices providing air flow for drawing the cooled filaments, said drawing assembly including a vertical drawing slot having an inlet opening and an outlet opening through which filaments pass with air to form a laterally extending curtain of drawn filaments, said drawing slot being formed by laterally extending spaced-apart walls terminating at the outlet opening, said drawing slot having a lateral extent to receive said curtain of drawn filaments, a diffuser having an inlet zone including a diffuser inlet opening having a lateral extent to receive said curtain of drawn filaments and being connected to a diffuser outlet zone including a diffuser outlet opening, said diffuser including a divergent nozzle and an electrostatically charging rail for opening drawn filaments which pass therethrough to form opened filaments, said divergent nozzle being formed by diverging walls terminating at said diffuser outlet opening, and a receiving belt for receiving said opened filaments, said diffuser outlet opening being spaced from said belt to form a receiving belt spacing, wherein an air flow slot is formed between the drawing assembly outlet opening and the diffuser inlet opening for delivery of a flow of air onto said filaments along the entire lateral extents of the openings, said air flow slot opening to ambient air for intake of air by a venturi effect produced in the divergent nozzle by air passing therethrough with said drawn filaments, and said receiving belt spacing being open to the ambient air.

* * * * *